US005901846A

United States Patent [19]

Betcher

[11] Patent Number: 5,901,846

[45] Date of Patent: May 11, 1999

[54] CARRYING AND SHIPPING CASE FOR CUTTING BLADES

[76] Inventor: Ryan J. Betcher, 2988 Wylie Dr., East Helena, Mont. 59635

[21] Appl. No.: 09/013,939

[22] Filed: Jan. 27, 1998

[51] Int. Cl.[6] ..... A45C 11/26

[52] U.S. Cl. ..... 206/349; 206/477; 206/445

[58] Field of Search ..... 206/349, 480, 206/231, 451, 452, 445, 352, 477

[56] References Cited

U.S. PATENT DOCUMENTS

| | | | |
|---|---|---|---|
| D. 227,234 | 6/1973 | Glaberson | D9/3 |
| D. 256,995 | 9/1980 | Kiraly | D9/186 |
| D. 313,175 | 12/1990 | Motta et al. | 206/352 |
| D. 320,342 | 10/1991 | Gray | D9/342 |
| 1,352,814 | 9/1920 | Kirk | 206/231 |
| 2,697,460 | 12/1954 | Barnett | 206/349 |
| 3,259,232 | 7/1966 | Elson et al. | 206/372 |
| 3,261,454 | 7/1966 | Elson et al. | 206/349 |
| 3,444,990 | 5/1969 | Braginetz | 206/352 |
| 3,822,781 | 7/1974 | Braginetz | 206/232 |
| 5,407,066 | 4/1995 | Grange | 206/228 |
| 5,782,346 | 7/1998 | Gray et al. | 206/228 |

*Primary Examiner*—Paul T. Sewell
*Assistant Examiner*—Nhan T. Lam
*Attorney, Agent, or Firm*—Jerry Johnson

[57] ABSTRACT

A carrying and shipping case for cutting blades which comprises a case including at least first and second spaced apart opposing side panels where the first and second spaced apart opposing side panels define an intervening interior blade securing area when the case is in a closed condition. A blade support surface is disposed within the case interior above the interior surface of the first side panel. And, at least one clamp is disposed within the case interior for securing the blade in contact with the blade support surface. The clamp is typically temporarily secured to the first case side panel and includes a first contact surface to engage a top horizontal surface of a cutting blade disposed on the blade support surface and a second contact surface to engage a vertical surface of the cutting blade. A blade contact surface is disposed above the blade support surface. The blade contact surface is typically disposed at an inclined angle relative to the blade support surface for providing an abutment surface for a beveled edge of a cutting blade.

11 Claims, 8 Drawing Sheets

CARRYING AND SHIPPING CASE FOR CUTTING BLADES

BACKGROUND

Cutting blades are used extensively in paper cutting machines used in the printing industry. The cutting blades used in paper cutting machines and other machines used in production printing facilities require frequent re-sharpening to maintain a cutting edge on the blade which is able to produce high quality cuts. The cutting blades used in these machines are both expensive and heavy, creating difficulty if the blades need to be shipped periodically for sharpening service.

Although cutting blades of this type are not extremely fragile, the blades must be handled carefully during shipping to avoid damaging the blades. Such damage could include bending the blade or breaking off a portion of the edge of the hardened steel or stainless steel blade. Damage to a blade can result in a long machine down time while a new blade is found. A delay such as this adds a considerable expense to the replacement of an already expensive blade.

The excessive weight adds to the difficulty of shipping cutting blades for sharpening service. Because of the weight of these blades, there is an obvious difficulty in their handling. The difficulty is even greater when taking into account the sharp edge that exists on the cutting blade. The weight of the blade will easily force the blade through anything that accidently comes in contact with the blade should the blade be dropped or mishandled. The risk of injury to workers involved in the handling and shipping of these cutting blades is obvious.

Despite the difficulties associated with handling and shipping cutting blades for sharpening service there are currently no cases commercially available that assist in these frequent procedures. Currently most cutting blades are shipped in wooden crates or boxes that offer only a small amount of protection to the cutting blade during transport and often require the use of threaded holes in the cutting blades that are required for reassembly of the blade into the machine in which it operates. Using the threaded holes during transport can damage these threads which are quite difficult to repair in hardened steel or stainless steel blades. Furthermore, the wooden crates are brittle and may easily break under the weight of a heavy cutting blade if dropped. Should a sharp, heavy cutting blade break through the wooden crate the blade could be irreparably damaged and severe injuries could also result. The cutting blades are also difficult to load into wooden crates which often open only on a single end of the crate. The difficulty in loading a heavy, sharp cutting blade into the end of a wooden crate presents many obvious risks to workers engaged in this procedure.

For the foregoing reasons there is a need for a carrying and shipping transport case for cutting blades that allows cutting blades to be shipped with out the potential that the blade could be damaged if the case were dropped or otherwise mishandled. There is a further need that the case would maintain the blade within the interior of the case should the case be dropped or mishandled. There is a further need that the case allow a blade to be secured within the case without using threaded holes on the blade which are critical to the proper reassembly of the cutting blade within printing machines such as paper cutters. There is an additional need for a case that allows the user to easily place and secure a heavy, sharp cutting blade into the interior of the case and to be able to secure the blade within the case without any difficulty, thus limiting the risks involved in this procedure.

There is an additional need for a case that can accommodate the varying bolt hold patterns and blade sizes of various manufacturer's blades.

SUMMARY

The present invention comprises a carrying and shipping case for cutting blades which comprises a case including at least first and second spaced apart opposing side panels where the first and second spaced apart opposing side panels define an intervening interior blade securing area when the case is in a closed condition. At least one side panel includes upstanding peripheral walls enclosing the intervening blade securing area. The peripheral walls are disposed along the periphery of that panel and extend toward the opposing panel when the case is in the closed condition. A blade support surface is disposed within the case interior on the interior surface of the first side panel. And, at least one clamp is disposed within the case interior for securing the blade in contact with the blade support surface.

The clamp is typically temporarily secured to the first case side panel and includes a first contact surface to engage a top horizontal surface of a cutting blade disposed on the blade support surface and a second contact surface to engage a vertical surface of the cutting blade. A blade contact surface is disposed above the blade support surface. The blade contact surface is typically disposed at an inclined angle relative to the blade support surface for providing an abutment surface for a beveled edge of a cutting blade. In one version of the case, the blade contact surface extends from the blade support surface at an inclined angle of approximately 20 degrees.

The clamp is disposed at a spaced apart distance from the blade contact surface. The clamp second contact surface serves to maintain a beveled edge of a cutting blade in abutment with the blade contact surface.

The case further includes a clamp fastener. The clamp is secured to the first case side panel by the clamp fastener; and the clamp further includes a longitudinal slot. The clamp fastener extends through the longitudinal slot of the clamp to permit the clamp to be secured into a temporary fixed position relative to the first side panel.

In a second version of the case, the case further includes a second support panel disposed on the interior of the case first side panel. A blade support surface including a blade contact surface extending therefrom, and at least one clamp fastener are attached to the second support panel. In this version of the case, the blade support surface and the clamp fastener are secured to the case first side panel through the attachment of the second support panel to the interior of the case first side panel.

The clamp typically includes a substantially planar body having a first and second end. The first and second blade contact surfaces are disposed at a first end of the body; and are typically adjacent to each other. The clamp further includes a leg extending downwardly from the second end of the clamp body, and a longitudinal slot disposed through the clamp body intermediate the first and second ends of the clamp body.

The leg, in one version of the case, is a threaded fastener. In this version, the clamp further includes a threaded hole proximate to the second end of the clamp body and the case further includes a clamp fastener. The clamp is loosely secured to the case first side panel through the clamp fastener which extends through the longitudinal slot in the clamp body. Increasing the leg length extending downwardly from the second end of the clamp body urges the first contact surface of the clamp downward to press downwardly on a blade disposed within the case.

The carrying and shipping case for cutting blades of the present invention offers benefits that have previously been unavailable.

A first benefit of the carrying and shipping case is a high level of protection offered for expensive blades that are shipped periodically for sharpening service. The case ensures that the blade will not incur any damage even if the case is dropped or otherwise mishandled. As even a small amount of damage to a blade would render the blade unusable, the case provides insurance that no such damage will occur.

A second benefit of the carrying and shipping case is the unlikelihood that the cutting blade could be accidently separated from the case. Even if extensive case damage occurs the blade should remain secured within the case and will not exit the case where the heavy, sharp blade could do damage to property or cause injury. There are obvious liability concerns with shipping potentially hazardous items like cutting blades and without a case of this type, substantial risks are unnecessarily incurred.

An additional benefit of the carrying and shipping case of the present invention is the use of a high quality clamping system that does not use existing threaded holes in the cutting blades. The use of existing threaded holes in the cutting blades by wooden crates has periodically caused damage to these holes. This damage makes the use of the threaded holes difficult when reassembling the cutting blade into the machine in which it operates.

Another benefit of the carrying and shipping case is the ease in which a blade can be placed and secured within the case. The dangers associated with handling a sharp, heavy blade are greatly minimized by the case which offers the user an easy surface on which to place the blade. After the blade is placed within the case, the blade is easily clamped into a secure position within the case interior. In no instance does the user need to place their hands close to the sharp edge of the blade during this procedure. The case also makes the process easy on the back of the user who may be lifting an unwieldy blade weighing 50 pounds. These and other advantages of the present invention will become apparent upon inspection of the accompanying specification, claims, and drawings.

DRAWINGS

DESCRIPTION

Figure 1:
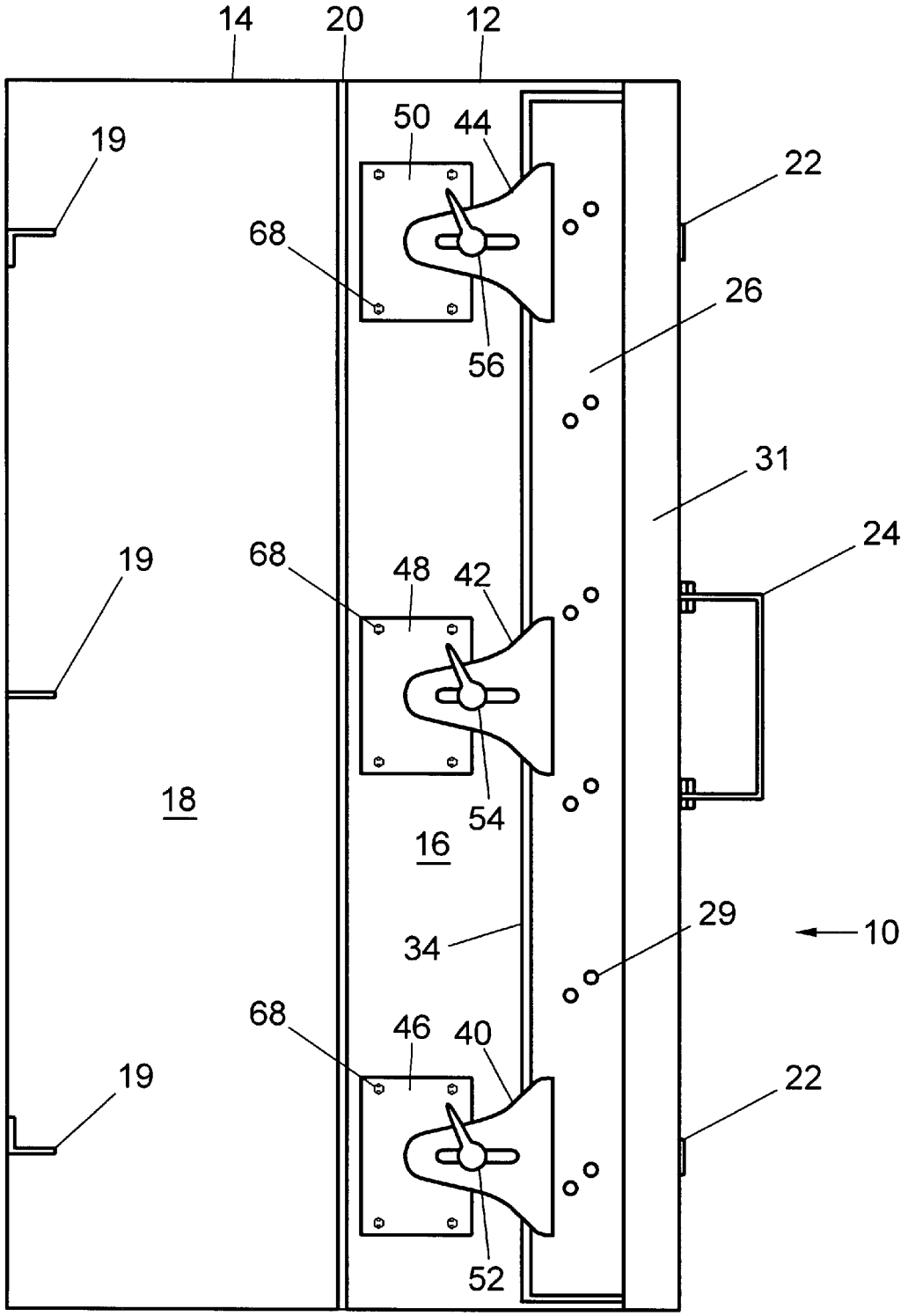
FIG. 1 is a top view of the first version of the carrying and shipping case for cutting blades of the present invention. The case is shown in a fully open condition.

In greater detail, FIG. 1 shows a top view of a first version 10 of the carrying and shipping case of the present invention. In this figure, the carrying and shipping case 10 is shown in a fully open condition and includes a case bottom section 12, which includes a first side panel 16, and a case top section 14, which includes a second side panel 18. The case further includes a hinge 20 attaching the top section to the bottom section. The case bottom section 12 includes a handle 24 and latches 22 which secure the two case sections together when the case is closed.

Secured in the case bottom section 12 is a cutting blade 26. Cutting blade 26 includes threaded holes 29 which are used to mount the blade within a paper cutting machine or other machine that has cutting capabilities. The cutting blade 26 is supported by a blade support surface which is hidden in this view by the cutting blade 26 and a thin pad 34 which is disposed on top of the cutting blade support surface. In this version of the carrying and shipping case, the blade support surface comprises a portion of the interior surface of the first side panel 16 above which the cutting blade is placed for securement within the case 10. The beveled edge of the cutting blade is also hidden from view in this figure by blade stop 31 which is disposed on the case bottom section 12 and provides an abutment surface for the beveled edge of a cutting blade.

FIG. 1 additionally shows the clamping assembly used to secure the blade 26 within the case 10. The clamping assembly includes clamps 40, 42, and 44 which are secured to the case first side panel 16 by speed nuts 52, 54, and 56. The clamps 40, 42, and 44 are shown overlapping the back edge of the cutting blade. Clamp support plates 46, 48, and 50 provide a secure surface on which the clamps are supported on the first side panel 16 opposite the cutting blade 26. The clamp support plates 46, 48, and 50 are attached to the first side panel 16 by suitable fasteners shown at 68.

Figure 2:
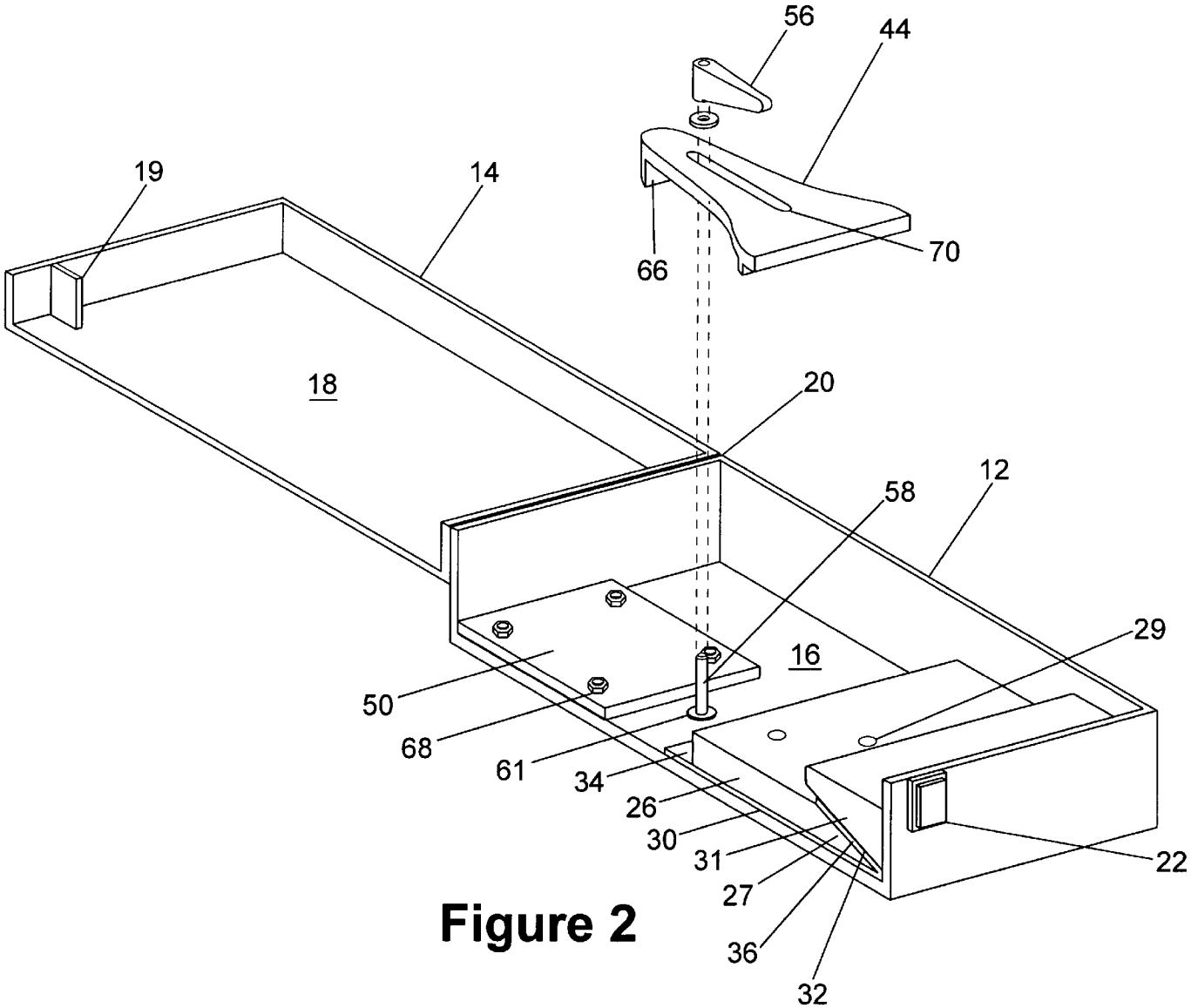
FIG. 2 is a partially exploded perspective view of a portion of the carrying and shipping case.

FIG. 2 is a partial perspective view showing a portion of the case assembly with the clamp 44 exploded from the remainder of the case. This view shows the engagement of the beveled edge 27 of the cutting blade 26 on the blade contact surface 32 of blade stop 31. Blade contact surface 32 is shown including a thin pad 36 which is shown being continuous with pad 34 disposed on the blade support surface 30.

As is shown in this figure, the cutting blade 26 is placed in the case bottom section 12 into a position where the beveled edge 27 of cutting blade 26 abuts the inclined blade contact surface 32. The inclined blade contact surface 32 is the bottom surface of the blade stop 31. The blade stop 31 may be molded into the case bottom section 12 or may be a separate assembly attached to the interior surface of the case bottom section 12 front wall. Pads 34 and 36 which cover the blade support surface 30 and the blade contact surface 32 may comprise a coating on these surfaces. In some instances these pads may not be needed in the case assembly.

FIG. 2 additionally shows a clamp fastener 58 which is secured to the first side panel 16 by retaining clip 61. The clamp 44 has a substantially planar body which includes a longitudinal slot 70. The clamp fastener 58 extends through the slot 70 where it is engaged by a speed nut 56 which temporarily secures the clamp 44 to the first side panel. The clamp 44 includes a first end that engages the back edge of the cutting blade 26. The second end of clamp 44 includes a leg 66 which is supported by the clamp support plate 50.

FIG. 2 also shows the addition of upstanding peripheral walls on both side panels 16 and 18. The upstanding peripheral walls entirely enclose the interior of the case when closed.

Figure 3:
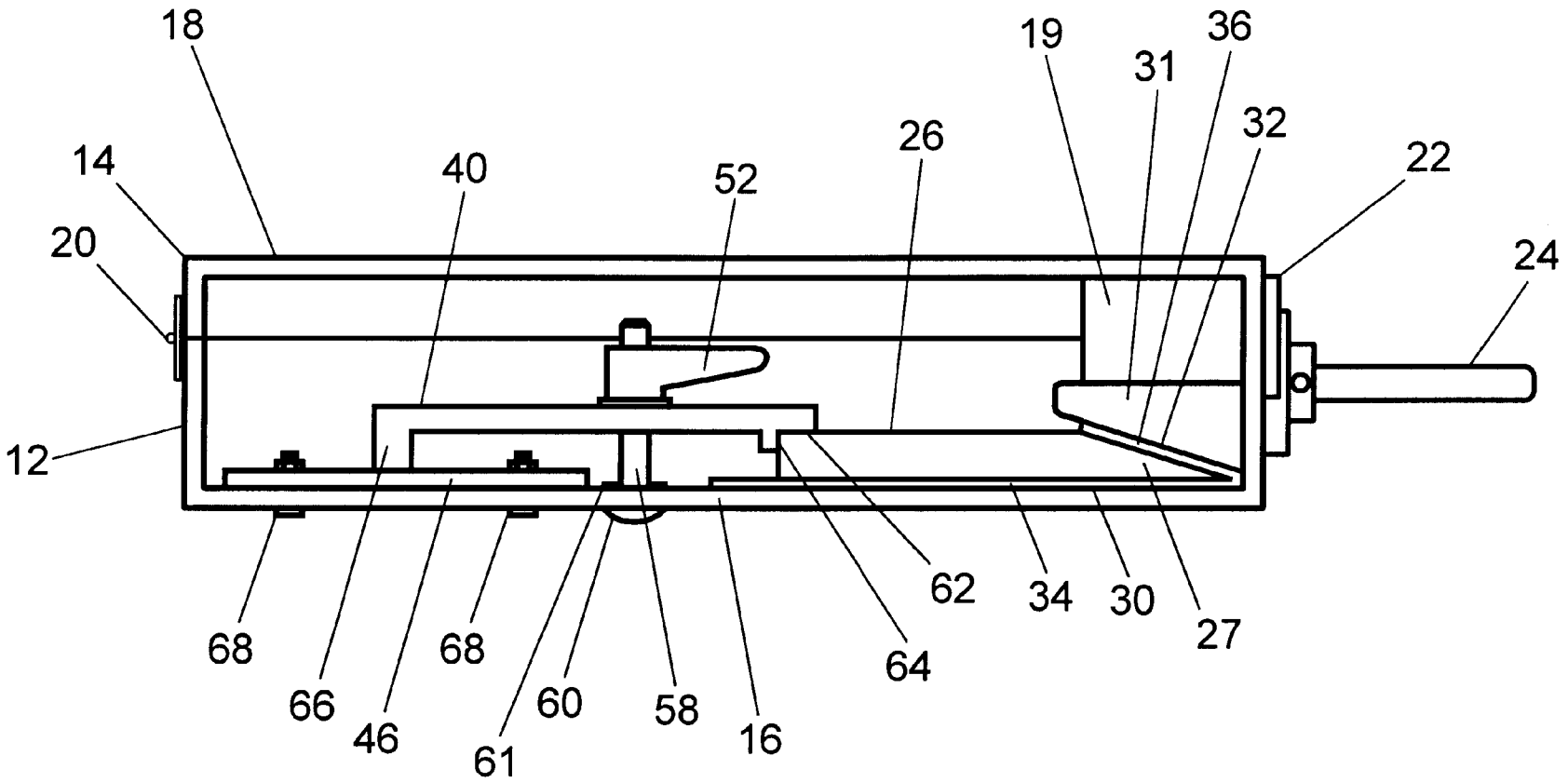
FIG. 3 is a side view of the case of FIG. 1 shown with the case cut away to expose the interior of the case.

FIG. 3 is a side view which shows the engagement of the clamp 40 on the back edge of the cutting blade 26 in greater detail. In this figure, the clamp first end includes a first contact surface 62 which engages a top horizontal surface of the back edge of cutting blade 26. The clamp includes a second contact surface 64 adjacent to the first contact surface 62 which engages a vertical surface of the back edge of cutting blade 26. FIG. 3 additionally shows how the clamp 40 is temporarily secured to the first side panel 16 through the clamp fastener 58 and speed nut 52. Additionally shown is the clamp leg 66 which is supported on clamp support plate 46.

FIG. 3 further shows how the opposing side panels 16 and 18 define an interior blade securing area when the case is in a closed condition. Also shown in this figure is support web 19 which is attached to the second side panel 18 and which provides support to the blade stop 31 when the case is closed.

Figure 4:
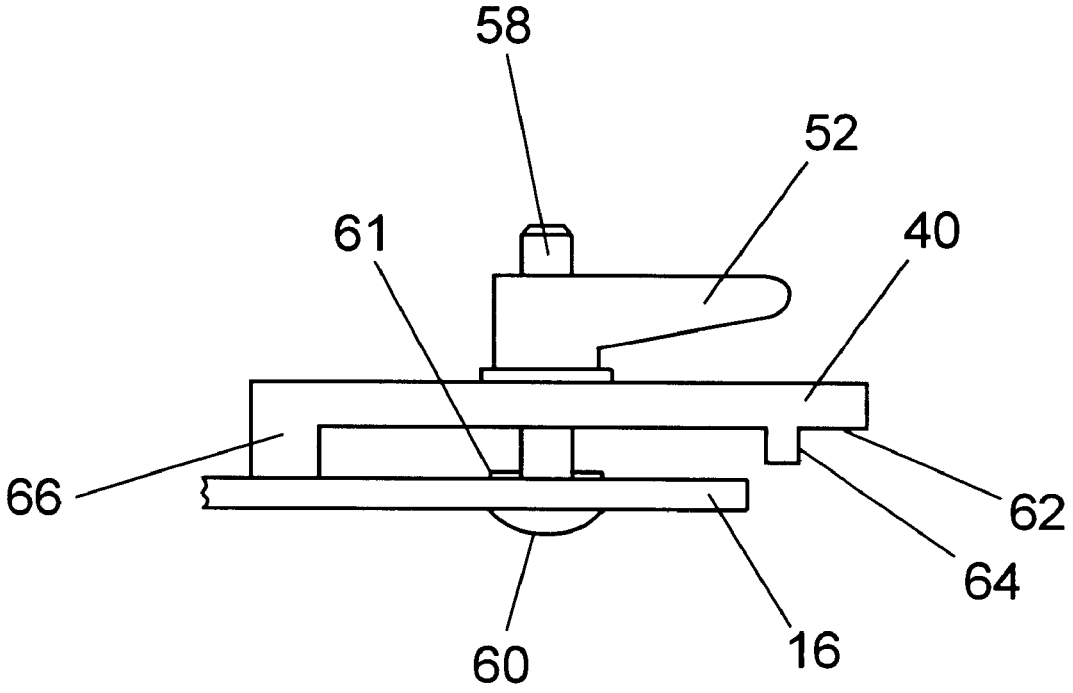
FIG. 4 is a side view of the clamp assembly used in the first version of the invention.

FIG. 4 shows the clamp 40 in greater detail. FIG. 4 additionally shows how the clamp fastener 58 includes a retaining clip 61 which secures the fastener 58 in a position where the fastener head 60 is engaged to the bottom surface of first side panel 16.

Figure 5:
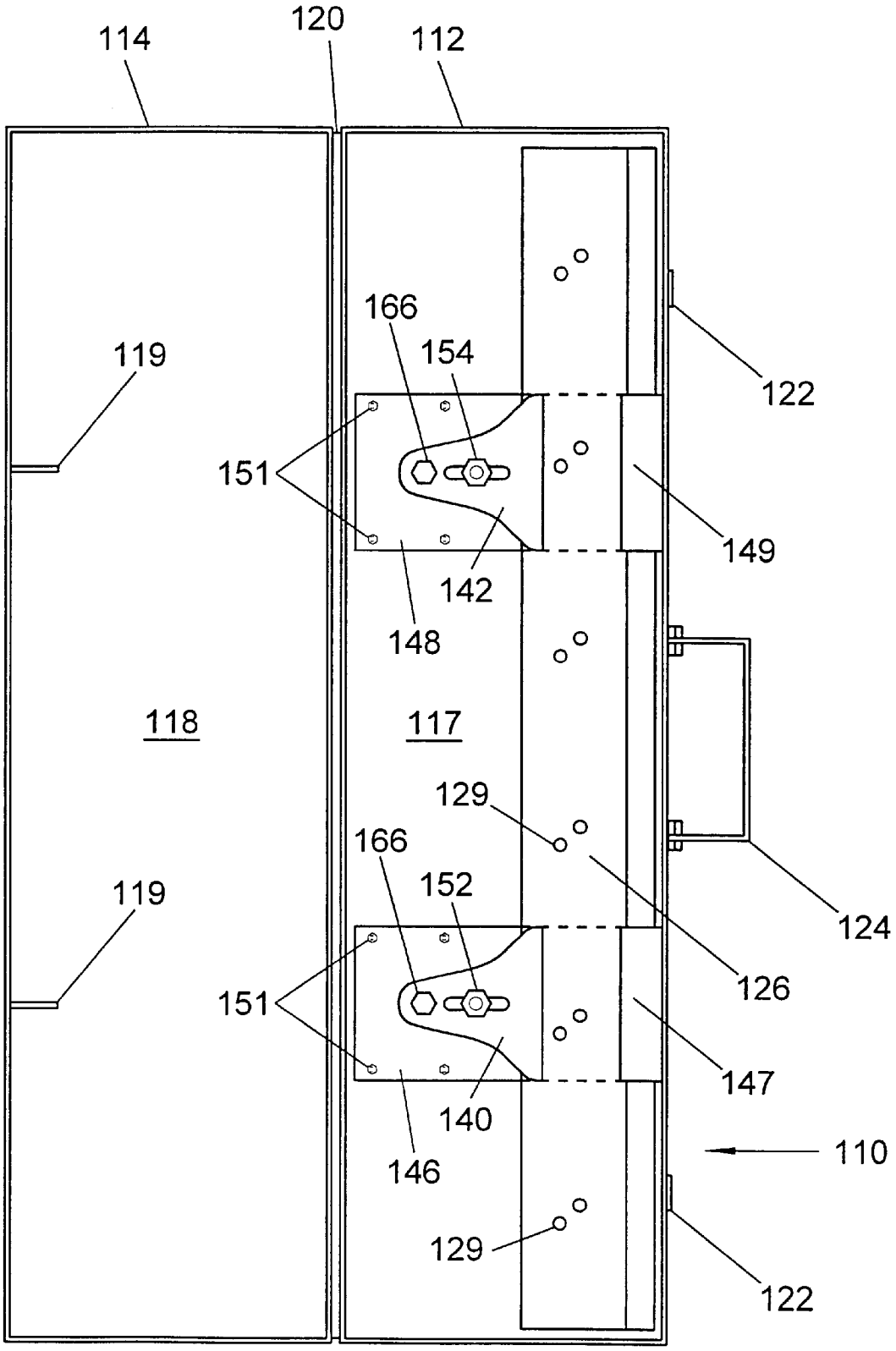
FIG. 5 is a top view of the second version of the carrying and shipping case for cutting blades of the present invention. The case is shown in a fully open condition.

FIG. 5 shows a top view of a second version 110 of the carrying and shipping case of the present invention. In this figure, the carrying and shipping case 110 is shown in a fully open condition and includes a case bottom section 112, which includes a first side panel 16, which is not shown in this figure as it is covered by a second support panel 117 which is disposed in the case bottom section 112 on top of the first side panel 116. FIG. 5 also shows a case top section 114, which includes a second side panel 118. The case further includes a hinge 120 attaching the top section to the bottom section. The case bottom section 112 includes a handle 124 and latches 122 which secure the two case sections together when the case is closed.

Secured in the case bottom section 112 is a cutting blade 126. Cutting blade 126 includes threaded holes 129 which are used to mount the blade within a paper cutting machine or other machine that has cutting capabilities. The cutting blade 126 is supported by first and second blade and clamp support plates 146 and 148 which are partially hidden in this view by the cutting blade 126 and clamps 140 and 142. First and second blade and clamp support plates 146 and 148 each provide a blade support surface for cutting blade 126. First and second blade and clamp support plates 146 and 148 also include a blade contact surface 147 and 149, respectively which provide an abutment surface for the beveled edge of a cutting blade. The blade contact surfaces extend from the blade support surfaces at an inclined angle of approximately 20 degrees.

FIG. 5 additionally shows the clamping assembly used to secure the blade 126 within the case 110. The clamping assembly includes clamps 140, and 142 which are secured to the case second support panel 117 by self locking nuts 152, and 154. The clamps 140, and 142 are shown overlapping the back edge of the cutting blade. First and second blade and clamp support plates 146, and 148 provide a secure surface on which the clamps are supported opposite the cutting blade 126. The first and second blade and clamp support plates 146, and 148 are attached to the second support panel 117 by suitable fasteners shown at 151. The second support panel 117 is secured to the first side panel of the case bottom section by a suitable means such as adhesives or fasteners. Accordingly, the second support panel 117 provides a means through which the first and second blade and clamp support plates are effectively permanently attached to the first side panel of the case bottom section, and also provide a means through which the clamps 140 and 142 are temporarily secured to the first side panel of the case bottom section.

Figure 6:
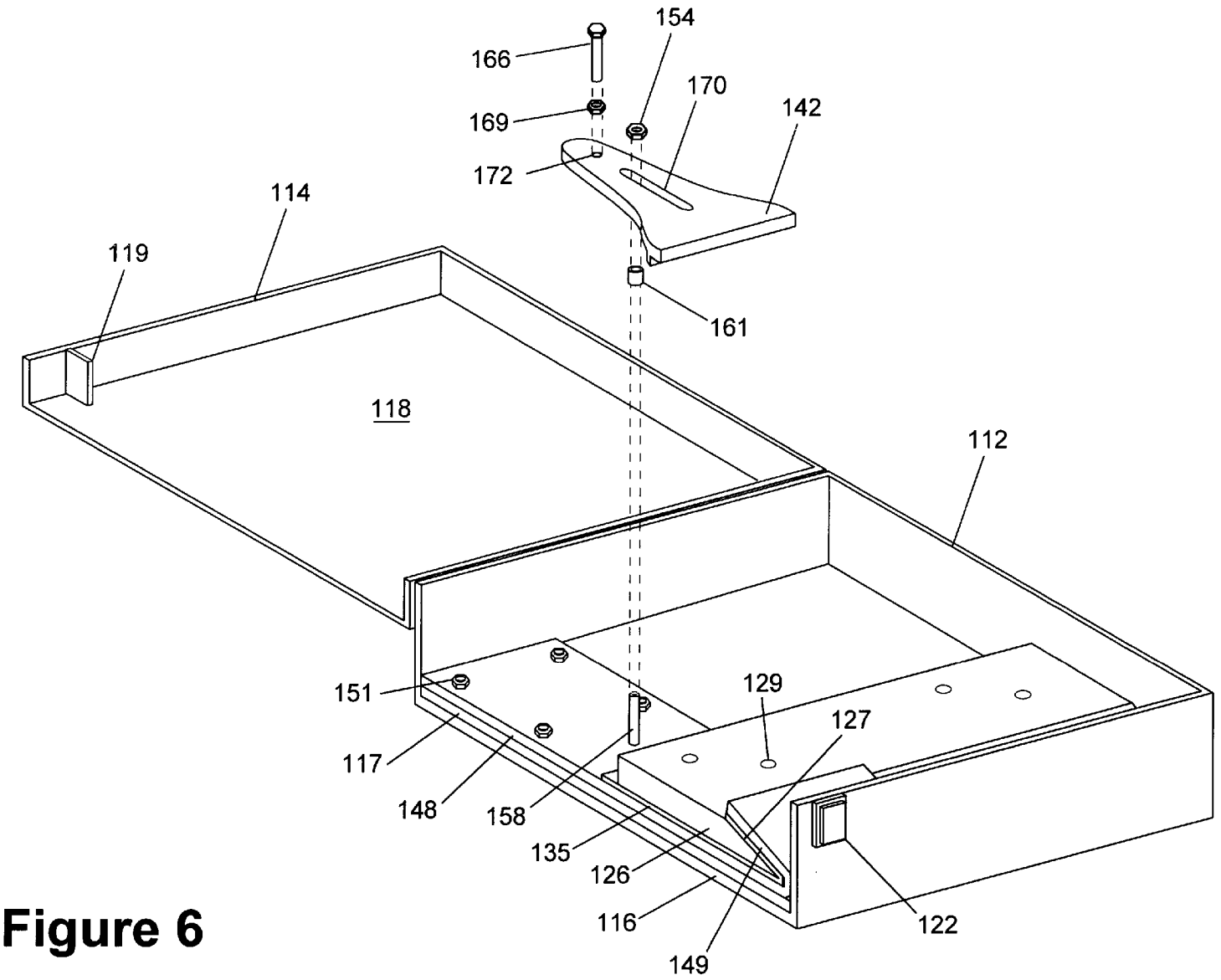
FIG. 6 is a partially exploded perspective view of a portion of the carrying and shipping case of FIG. 5.

FIG. 6 is a partial perspective view showing a portion of the case assembly with the clamp 142 exploded from the remainder of the case. This view shows the engagement of the beveled edge 127 of the cutting blade 126 on the blade contact surface 149. Blade contact surface 149 is shown including a thin pad 135 which is also shown being disposed on the blade support surface of the blade and clamp support plate 148.

As is shown in this figure, the cutting blade 126 is placed in the case bottom section 112 into a position where the beveled edge 127 of cutting blade 126 abuts the inclined blade contact surface 149. The inclined blade contact surface 149 extends from the blade support surface of the plate 148. Pad 135 which covers the blade support surface and the blade contact surface may comprise a coating on these surfaces. In some instances these pads may not be needed in the case assembly.

FIG. 6 additionally shows a clamp fastener 158 which is secured to the second support panel 117. The clamp 142 has a substantially planar body which includes a longitudinal slot 170. The clamp fastener 158 extends through the slot 170 where it is engaged by a self locking nut 154 which loosely temporarily secures the clamp 142 to the second support panel 117. The clamp 142 includes a first end that engages the back edge of the cutting blade 126. The second end of clamp 142 includes a leg 166 which is supported by the blade and clamp support plate 148. The threaded fastener includes a nut 169 to lock the fastener into a desired position.

FIG. 6 also shows the addition of upstanding peripheral walls on both side panels 116 and 118. The upstanding peripheral walls entirely enclose the interior of the case when closed.

Figure 7:
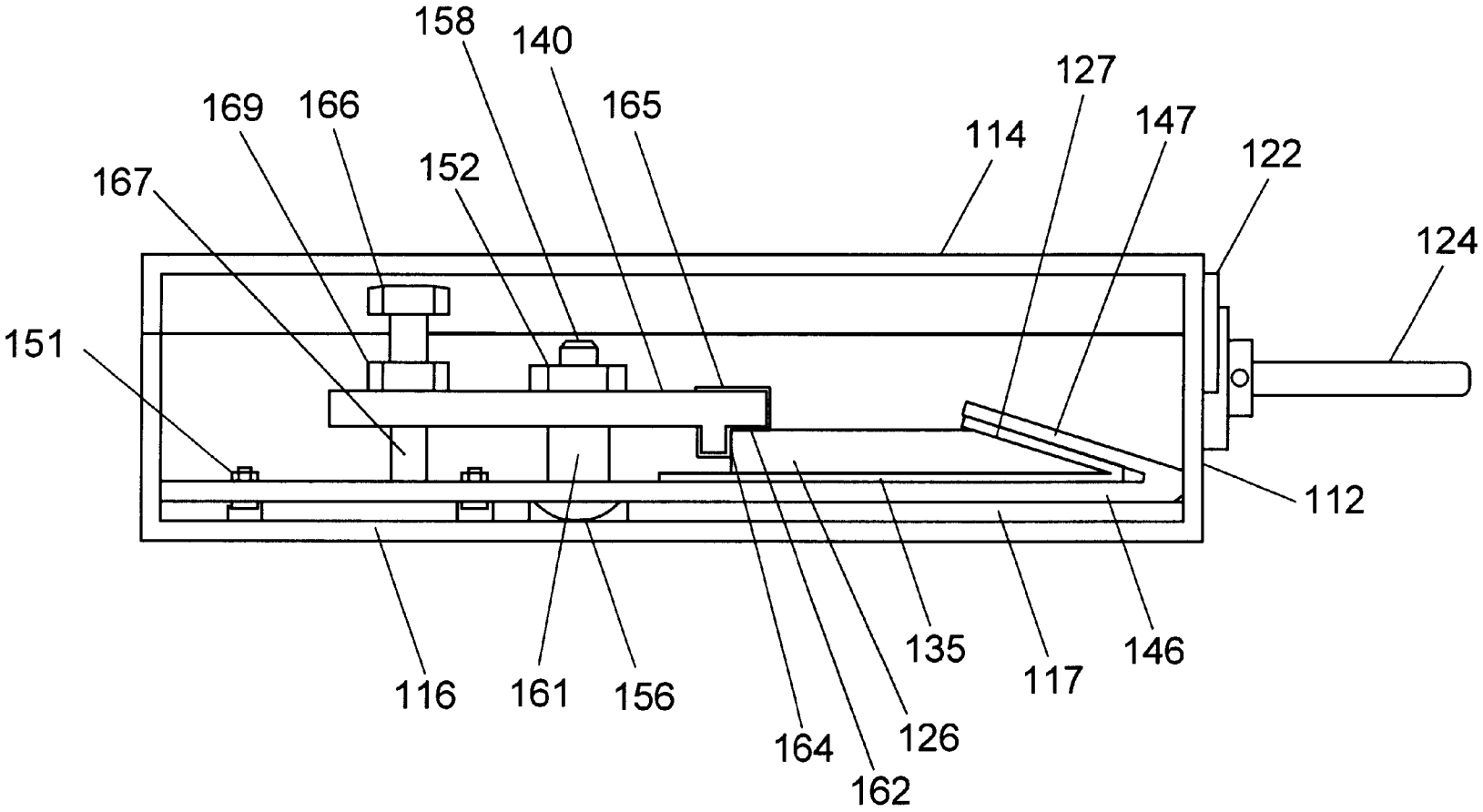
FIG. 7 is a side view of the case of FIG. 5 shown with the case cut away to expose the interior of the case.

FIG. 7 is a side view which shows the engagement of the clamp 140 on the back edge of the cutting blade 126 in greater detail. In this figure, the clamp first end includes a first contact surface 162 which engages a top horizontal surface of the back edge of cutting blade 126. The clamp includes a second contact surface 164 adjacent to the first contact surface 162 which engages a vertical surface of the back edge of cutting blade 126. FIG. 7 additionally shows how the clamp 140 is temporarily secured to the second support panel 117 through the clamp fastener 158 and self locking nut 152. Additionally shown is the clamp leg 166 which is supported on the blade and clamp support plate 146. The leg comprises a threaded fastener 166 which has a lower portion 167 extending below the clamp. FIG. 3 further shows how the opposing side panels 116 and 118 define an interior blade securing area when the case is in a closed condition.

Figure 8:
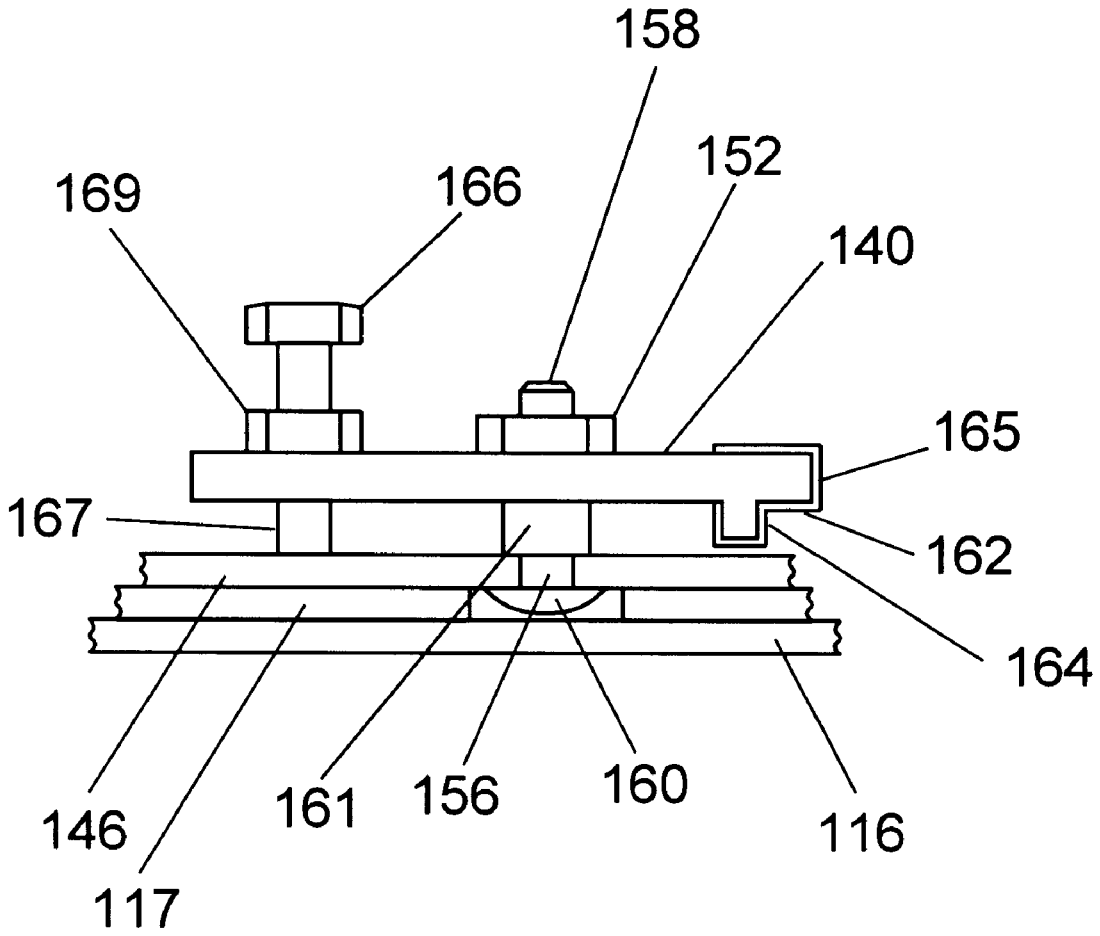
FIG. 8 is a side view of the clamp assembly used in the second version of the invention.

FIG. 8 shows the clamp 140 in greater detail. FIG. 8 additionally shows how the loosely secured clamp fastener 158 includes a spacer 161 which maintains the clamp at an elevation where the first end of the clamp including the first blade contact surface 162 easily slide over the back edge of a cutting blade. The spacer 161 further acts as a surface about which the entire clamp 140 pivots when the threaded leg 166 is threaded further into a threaded hole 172 (see FIG. 6) in the clamp, which increases the length of the lower portion 167 of the leg 166 which extends beneath the clamp. As the lower portion 167 of the leg 166 increased in length, the clamp second end proximate to the leg 166 rises. This causes the first end of the clamp to lower as the clamp pivots about the spacer 161. The lowering of the first end of the clamp urges the first blade contact surface 162 onto the top surface of the blade back edge to thus provide a clamping force on the blade.

The two versions of the carrying and shipping case of the present invention are simple in their use. The process of placing a cutting blade in either of the versions of the case is identical. There are minor differences in applying a clamping force on the blade due to the differences in the clamp designs of the two versions of the invention.

The process of placing a cutting blade into the case of either of the two versions of the invention is merely a process of: opening the case fully; moving the clamps to a sufficient distance away from the blade contact surface or surfaces so that the clamps will not interfere in the placement of the cutting blade within the case; setting the cutting blade on the blade support surfaces; pushing the blade into engagement with the blade contact surface or surfaces; placing the first blade contact surface of each clamp on the top surface of the cutting blade back edge; moving each clamp forward toward the cutting blade until the second blade contact surface of each clamp is in contact with the back edge of the cutting blade; securing the clamps in place so that clamp applies a downward clamping pressure on the back edge of the cutting blade which also holds the beveled cutting edge of the cutting blade in engagement with the blade contact surface or surfaces.

In the first version of the invention as is shown in FIGS. 1–4, the clamps 40, 42, and 44 are secured into place by tightening speed nuts 52, 54, and 56. This quickly applies the necessary downward pressure on the blade back edge to secure the cutting blade within the case.

In the second version of the invention as is shown in FIGS. 5–8, the clamps 140 and 142 are secured in place by first loosening the nuts 169 and then tightening down on the adjustable height legs 166 which are threaded fasteners. By tightening down on the legs 166, the clamps tilt forward as the clamps pivot about the spacers 161. The tightening causes the first blade contact surfaces 162 to press downwardly on the blade back edge to secure the cutting blade within the case. The nuts 169 are then tightened to secure the position of the adjustable height legs 166.

The carrying and shipping case for cutting blades would typically be constructed of high strength plastics by known plastic molding techniques. The clamps and support plates would typically be fabricated from aluminum or steel but could be made from other materials, as well. The case could be manufactured in a variety of widths and strengths to accommodate a variety of cutting blade sizes.

It is understood that modifications could be made in the carrying and shipping case of the present invention. A first modification would be the use of a clamp having a more linear shape that shown in FIGS. 1–8. The use of fewer or a greater number of clamps within the case is also possible as a single clamp would be sufficient in many instances, while in other instances a large number of clamps may be required. The case interior could include the use of protective foams such as convoluted foams. A blade edge cover could be used in the second version of the invention to cover the portion of the blade edge not in engagement with the blade contact surfaces. The case could be manufactured to accommodate more than one blade, if desired. The case could also be manufactured with more than one handle and could include wheels, as well. Although the carrying and shipping case is manufactured to accommodate cutting blades used in the printing industry it is understood that the case could be used with many different types of cutting blades.

It is further understood that various other modifications and changes of form or detail could readily be made without departing from the spirit of the invention. It is therefore intended that the invention be not limited to the exact form and detail herein shown and described, nor to anything less than the whole of the invention herein disclosed and hereinafter claimed.

I claim:

1. A carrying and shipping case for cutting blades comprising:

a case including at least first and second spaced apart opposing side panels;

the first and second spaced apart opposing side panels defining an intervening interior blade securing area when the case is in a closed condition;

at least one side panel including upstanding peripheral walls enclosing the intervening blade securing area; wherein the peripheral walls are disposed along the periphery of that panel and extend toward the opposing panel when the case is in the closed condition;

a blade support surface disposed within the case interior on the interior surface of the first side panel;

at least one clamp disposed within the case interior for securing a cutting blade in contact with the blade support surface; and wherein the clamp is disposed within the case interior at a location proximate to the blade support surface wherein the clamp may be vertically disposed directly above at least a portion of the cutting blade disposed on the blade support surface; and wherein the clamp is disposed for the direct application of a clamping force on the cutting blade.

2. The case of claim 1, wherein the clamp is temporarily secured to the first case side panel and wherein the clamp includes a first contact surface to engage a top horizontal surface of a cutting blade disposed on the blade support surface and a second contact surface to engage a vertical surface of the cutting blade.

3. The case of claim 2, further comprising a blade contact surface disposed above the blade support surface.

4. The case of claim 3, wherein the blade contact surface is disposed at an inclined angle relative to the blade support surface for providing an abutment surface for a beveled edge of a cutting blade.

5. The case of claim 4, wherein the blade contact surface extends from the blade support surface at an inclined angle of approximately 20 degrees.

6. The case of claim 4, wherein the clamp is disposed at a spaced apart distance from the blade contact surface and wherein the clamp second contact surface serves to maintain a beveled edge of a cutting blade in abutment with the blade contact surface.

7. The case of claim 6, further including a clamp fastener;

wherein the clamp is secured to the first case side panel by the clamp fastener; and wherein the clamp further includes a longitudinal slot; wherein the clamp fastener extends through the longitudinal slot of the clamp to permit the clamp to be secured into a temporary fixed position relative to the first side panel.

8. The case of claim 2, wherein the first and second clamp contact surfaces are adjacent to each other.

9. The case of claim 5, further comprising a second support panel disposed on the interior of the case first side panel;

wherein a blade support surface including a blade contact surface extending therefrom, and at least one clamp fastener are attached to the second support panel; and wherein the blade support surface and the clamp fastener are secured to the case first side panel through the attachment of the second support panel to the interior of the case first side panel.

10. The case of claim 2, wherein the clamp includes a substantially planar body having a first and second end; wherein the first and second blade contact surfaces are disposed at a first end of the body; and wherein the clamp further includes a leg extending downwardly from the second end of the clamp body, and a longitudinal slot disposed through the clamp body intermediate the first and second ends of the clamp body.

11. The case of claim 10, wherein the leg is a threaded fastener, and where the clamp further includes a threaded hole proximate to the second end of the clamp body; and wherein the case further includes a clamp fastener; wherein the clamp is loosely secured to the case first side panel through the clamp fastener which extends through the longitudinal slot in the clamp body; and wherein increasing the leg length extending downwardly from the second end of the clamp body urges the first contact surface of the clamp downward to press downwardly on a blade disposed within the case.

* * * * *